United States Patent [19]

Iwaki

[11] Patent Number: 4,611,906

[45] Date of Patent: Sep. 16, 1986

[54] ELECTROPHOTOGRAPHIC COPYING APPARATUS

[75] Inventor: Hiroshi Iwaki, Kasai, Japan

[73] Assignee: Sanyo Electric Co., Ltd., Japan

[21] Appl. No.: 693,628

[22] Filed: Jan. 22, 1985

[51] Int. Cl.[4] ..... G03G 15/00

[52] U.S. Cl. ..... 355/14 R; 355/7

[58] Field of Search ..... 355/3 R, 7, 16, 14 R

[56] References Cited

U.S. PATENT DOCUMENTS

| | | | |
|---|---|---|---|
| 3,724,940 | 4/1973 | Koizumi | 355/3 R |
| 3,792,913 | 2/1974 | Simmons | 355/7 |
| 3,809,472 | 5/1974 | Liechty | 355/3 R |
| 3,901,593 | 8/1975 | Kogiso et al. | 355/3 R |
| 3,967,896 | 7/1976 | Looney et al. | 355/7 X |
| 4,215,929 | 8/1980 | Sato et al. | 355/7 |

*Primary Examiner*—R. L. Moses

*Attorney, Agent, or Firm*—Darby & Darby

[57] ABSTRACT

An electrophotographic copying apparatus of the present invention is capable of copying a reduced original and forms an electro-static latent image of the reduced original image on a uniformly electrified photosensitive member so that the electrostatic latent image is sensible-imaged as a toner image and the toner image is transferred onto copying paper. In such operation, this apparatus can change corresponding to reduction rate the irradiation area of a side erase lamp for erasing unnecessary charge at both axial edge portions of photosensitive member, thereby enabling complete removal of unnecessary electrified portions on the photosensitive member which appear inevitably when the reduced copying is carried out, and reliable prevention of attaching of unnecessary toner to the photosensitive member.

20 Claims, 6 Drawing Figures

ELECTROPHOTOGRAPHIC COPYING APPARATUS

BACKGROUND OF THE INVENTION

1. Field of the Invention

This invention relates to an electrophotographic copying apparatus for exposure-scanning an original through a slit, and irradiating onto an electrified photosensitive member the reflected light from the original to thereby form on the photosensitive member an electrostatic latent image, which is developed with toner, the image developed therewith being transferred to copying paper.

2. Description of the Prior Art

The electrophotographic copying apparatus electrifies the photosensitive member by applying thereto high voltage, and irradiates onto the electrified photosensitive member the reflected light from the original obtained by exposure-scanning thereof, thereby forming on the photosensitive member the electro-static latent image corresponding to the image of original. Then, the electro-static latent image is developed with the toner to thereby be sensible-imaged so that the sensible image is transferred to the copying paper.

In such electrophotographic copying apparatus, the photosensitive member has a surface area corresponding to the overall area of an original supporting plate. In a case where the original is smaller than the original supporting plate and is copied by equal magnification, unless the light is adapted to be reflected from the portion at the plate not covered by the original thereon, when the original is exposure-scanned, the charge on the side edge of photosensitive member other than the image of original is not dissipated so that the side edge is attached with the toner to be developed. Therefore, a white lid covers the original supporting plate to reflect the light even when the side edge of the original is exposed, but when the lid is open, the unnecessary attaching of toner is not avoidable.

When the charge on the abovementioned unnecessary portion is not dissipated, a very thick toner is attached onto the photosensitive member so that, when a copying paper larger than the original is copied in equal size, an unnecessary band-like image is formed around the image of original on the paper, resulting in deterioration of quality of copying. Also, even after copying, toner usually remains on the photosensitive member, which need be removed so as to prevent deterioration of the copying quality. Since the side edge portions other than the image of original on the photosensitive member are attached with the very thick toner as abovementioned, the toner is not completely transferred, but remains on the photosensitive member. For copying paper equal in size to the original, the toner at the side edge of photosensitive member is not transferred to the copying paper, but remains as a whole on the photosensitive member, whereby removal of the attached toner not only largely loads the machine but also produces much dust around the same, and further a large amount of toner is wasted so as to be not economical. For copying paper smaller than the original, the same problem as the above will be created.

In order to solve the above problem, an erase light source has been proposed which dissipates charge on the side edge areas of the photosensitive member at first electrified at the overall surface, the side edge areas being positioned perpendicularly to the moving direction of photosensitive member and unnecessary for forming the image of original.

Also, a device (disclosed in the U.S. Pat. No. 3,792,913) has been developed which detects the size of copying paper to change corresponding thereto the size of the projection areas of erase light source at the side edges perpendicular to the moving direction of photosensitive member, which dissipates the charge in the area of the photosensitive member not contacted by the copying paper during the transfer, thereby preventing unnecessary toner from attaching to the photosensitive member.

Recently, an electrophotographic copying apparatus has been developed, in which the image of original can be copied in reduction or enlargement via selective variation of the copying magnfication. The image of original, when copied in reduction, is formed on the photosensitive member in reduction by a set reduction rate relative to the actual original, resulting in that the electrified portion (the toner-attaching portion) unnecessary for copying at the photosensitive member is expanded. However, the light is reflected from the portion at the original support plate except for the portion supporting the original during the exposure-scanning, so that when the side edges of photosensitive member are exposed to the light, the charge at the same is dissipated, thereby preventing the unnecessary toner from attaching thereto. The area for the erase light source at the side edges of photosensitive member is changed corresponding to the size of copying paper as above mentioned to thereby ensure that toner is prevented from unnecessarily attaching to the photosensitive member, but when the image of original is reduced unnecessary attachment of toner cannot be, fully prevented. In brief, in a case where the area for the erase light source is changed corresponding to the aforesaid copying size, the charge at the side edges of photosensitive member cannot completely be dissipated because the reduction rate is irrelevant to the size of copying paper.

The image of the original can be exposed over the entire surface of the original support plate, and the photosensitive member is larger enough to be exposed to the entire image of the original on the original support plate, but when the original is copied in reduction, only the area corresponding to the reduction size of the plate is exposed to the reflected light therefrom, so that the side edges of photosensitive member are out of the exposure area so as to be not exposed. Hence, the side edges of photosensitive member, when reduced, are always electrified and attached with toner, whereby it is impossible in such a case to completely dissipate the side edge charge, resulting in unnecessary toner being attached to the side edges of the photosensitive member.

An electrophotographic copying apparatus (disclosed in the U.S. Pat. No. 3,724,940) has been developed for dissipating the charge on the side edges of photoelectric member even when reduced. This copying apparatus, which rotates a shade pivoted to one side of the copying apparatus to change the projection position of a correction light source, is not accurately controllable and causes unnecessary toner is attached to the photosensitive member.

OBJECTS OF THE INVENTION

A first object of the invention is to provide an electrophotographic copying apparatus which completely dissipates unnecessary charge around the image of an original formed on a photosensitive member when reduced and prevents attaching of unnecessary toner thereto, thereby saving the consumption of toner, largely reducing the amount of dust produced, and avoiding useless imaging on the copying paper.

A second object of the invention is to provide an electrophotographic copying apparatus which is capable of reliably dissipating with simple construction and high accuracy the unnecessary charge existing around the image of an original formed on the photosensitive member when copied in reduction.

A third object of the invention is to provide an electrophotographic copying apparatus which is capable of dissipating only from the areas centrally symmetrical to each other the unnecessary charge at each side edge of photosensitive member.

A fourth object of the invention is to provide an electrophotographic copying apparatus which is capable of changing the charge dissipating area with high accuracy by use of racks, pinions, and a stepping motor, and of being controlled in the home position to change the charge dissipating area with accuracy.

The above and further objects and features of the invention will more fully be apparent from the following detailed description with accompanying drawings.

DETAILED DESCRIPTION OF THE INVENTION

Figure 1:
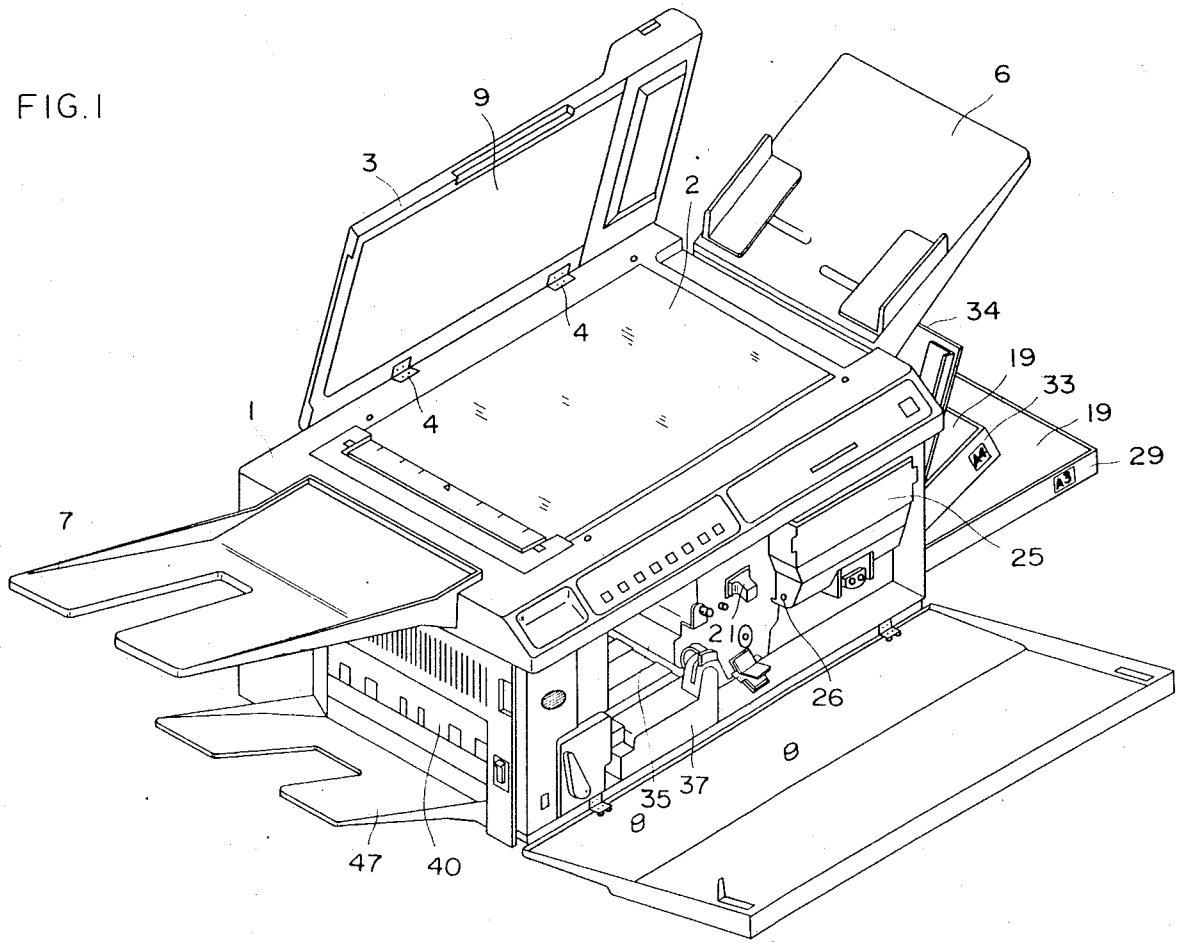
FIG. 1 is a perspective view of an embodiment of an electrophotographic copying apparatus of the invention.
Figure 2:
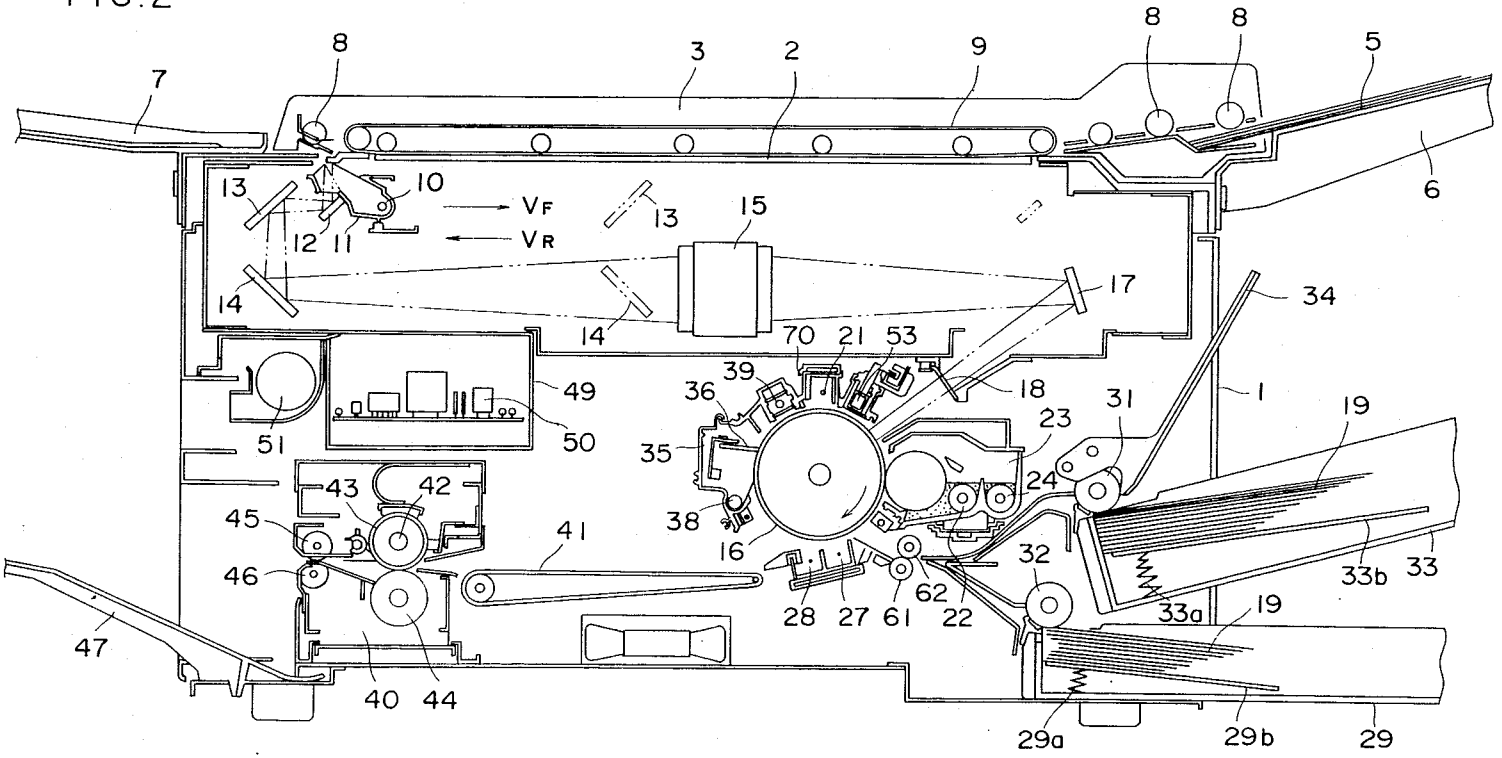
FIG. 2 is an internally structural view of the FIG. 1 embodiment.

Referring to FIGS. 1 and 2, reference numeral 1 designates a body of the copying apparatus, the body 1 providing at the upper portion thereof an original suport plate 2 of transparent glass fixed thereto and at the rear an automatic original transporting unit 3 mounted thereto in relation of being vertically movable through hinges 4, 4, the original transporting unit 3 is turned downwardly to abut against the upper surface of original support plate 2. At one side (rightward in the drawing) of automatic original transporting unit 3 is provided an original loader 6 on which originals 5, 5 . . . to be copied are loaded, and at the other side (leftward in the drawing) of the same is provided a tray 7 on which the copied originals are placed. A plurality of rollers 8, 8 . . . are provided at the original loader 6 side of automatic original transporting unit 3, an original transporting belt 9 is provided in continuation of the rollers 8, 8 . . . and about throughout the transporting unit 3 laterally thereof, and another roller 8 is provided in continuation of original transporting belt 9 at the tray 7 side thereof, the rollers 8, 8 . . . and belt 9 abutting against the uppermost original 5 at the loader 6, cooperating for placing the original 5 onto the original support plate 2, and the copied originals 5, 5 . . . being placed on the tray 7.

Under the original support plate 2, an exposure lamp 10 as an exposure-scanning unit is axially disposed widthwise of the plate 2 and movable lengthwise thereof, and under the exposure lamp 10 is mounted a reflector 11 for reflecting the light from the lamp 10 toward the original support plate 2, the reflector 11 being provided at the rear side with a first movable mirror 12 for reflecting the reflected light from the original 5 on the original support plate 2. Also, a pair of second movable mirrors 13 and 14 are vertically disposed at the leftward upper portion of the body 1 to thereby reflect toward the center of body 1 the reflected light from the first movable mirror 12. Near the central portion of the body 1 is disposed an image lens 15, so that when the exposure lamp 10 moves in reciprocation for scanning rightwardly in FIG. 2, the original 5 on the plate 2 is slit-exposed and the image of original 5 is reflected toward the image lens 15 through the first movable mirror 12 and pair of second movable mirrors 13 and 14, the image lens 15 comprising a zoom lens changeable of the copying magnification. A stationary reflector 17 is provided rightwardly of image lens 15 and a photosensitive drum 16 is disposed rightwardly downwardly of image lens 15, so that the image of original 5 having passed the image lens 15 is reflected toward the photosensitive drum 16 through the stationary reflector 17, and then reflected thereby to transmit through an infrared absorption filter 18 disposed between the stationary reflector 17 and the photosensitive drum 16, thereby being exposed thereon. In addition, a zoom ratio of image lens 15 is decided by a copying magnification setting switch (not shown).

The photosensitive drum 16 is adapted to rotate clockwise as shown by the arrow in FIG. 2 and a side erase lamp 53 is provided at the upstream side in the rotation direction of the exposure position of the image of original 15 at the photosensitive drum 16, the side erase lamp 53 serving to eliminate (side-erase) charge on the portion corresponding to the side edges of copying paper on the photosensitive drum 16. Around the side erase lamp 53 there is provided a shading means, to be detailed below, is provided around the side erase lamp 53.

At the upstream side to the side erase lamp 53 in the rotation direction of photosensitive drum 16 there an electrifying corotron 21 is housed in a support casing 70, and functions for uniformly plus-electrifying (up to about 600V) the photosensitive drum 16.

A development unit 23 is disposed at the downstream side to the exposure position in the rotation direction of photosensitive drum 16 so as to develop with toner electro-static latent images formed on the photosensitive drum 16. The development unit 23 is provided with screw conveyors 22 and 24 for agitating carriers with toner, and in front with a toner container 25 (see FIG. 1) for feeding the toner to the development unit 23. The toner container 25 is mounted swingably laterally through a support shaft 26.

At the downstream side to the development unit 23 in the rotation direction of photosensitive drum 16 there is provided a transfer corotron 27 for transferring the toner image on the photosensitive drum 16 to the copying paper. At the downstream side to the transfer corotron 27 there is provided adjacent thereto a separating corotron 28 for separating the copying paper from the photosensitive drum 16, the corotrons 27 and 28 being integral with each other to move toward or away from the photosensitive drum 16.

A cleaning unit 35 for removing from the photosensitive drum 16 the remaining toner not transferred to the copying paper is disposed leftwardly and upwardly of the separating corotron 28, which comprises a rubber blade 36 for scraping off the toner from the photosensitive drum 16, and a screw conveyor 38 for discharging the scraped-out toner into a discharged toner collector 37 (see FIG. 1).

Furthermore, an erase lamp 39 for eliminating the remaining charge on the photosensitive drum 16 is provided in advance of cleaning unit 35 in the rotation direction of drum 16, the electrifying corotron 21 being disposed in advance of erase lamp 39 in the rotation direction of the same.

A paper feed cassette 29 is mounted to the rightwardly lower portion of the body 1, is detachable from the inner bottom thereof, and contains copying papers 19, 19 . . . of A-3 size in layers, for example. At the inner bottom of cassette 29 there are provided a compression spring 29*a* and a support plate 29*b* for biasing upwardly the copying papers 19, 19 . . . within the cassette 29. A paper feed roller 32 is provided at the leftwardly upper portion of cassette 29, the uppermost copying paper 19 in the cassette 29 abutting against the paper feed roller 32. Above the paper feed cassette 29 there is detachably mounted a paper feed cassette 33 having the same construction as the cassette 29, in the latter of which copying papers 19, 19 . . . of A-4 size are contained in layers. The papers 19, 19 . . . and biased upwardly by a compression spring 33*a* and a support plate 33*b*, the uppermost paper 19 abutting against a paper feed roller 31.

The root of a manual paper feeder 34 is mounted rotatably in the vicinity of paper feed roller 31 at the upper paper feed cassette 33. The fore end of the latter projects outwardly from the right side of body 1, so that the fore end is turned downwardly and copying paper 19 is placed on the manual paper feeder 34, thereby enabling manual paper feeding.

The copying paper 19 placed on each paper feed cassette 29 or 33, or the manual paper feeder 34. The paper 19 is transported by the paper feed roller 32 or 31, to a pair of register rollers 61 and 62, and then transported via the latter to above the transfer corotron 27 and separating corotron 28, so that the toner image on the photosensitive drum 16 is transferred and the copied paper is separate from the drum 16.

A vacuum conveyor 41 is disposed at the horizontally left side of separating corotron 28, that is, at the downstream side in the transportation direction of copying paper 19, and a fixing unit 40 is disposed at the downstream side of vacuum conveyor 41, so that the copying paper 19 on which the toner image is transferred is transported to the fixing unit 40 through the vacuum conveyor 41.

The fixing unit 40 contains therein a heating roller 43 housing therein a heater 42 and a pressure roller 44 in press-contact with the heating roller 43, the toner not yet fixed to the copying paper 19 being heated and pressurized by both rollers 43 and 43, thereby being fixed to the copying paper 19. At the downstream side to the fixing unit 40, a pair of discharge rollers 45 and 46 are provided for discharging the copying paper 19 from the fixing unit 40 into a paper discharge tray 47 extending at the lefthand end outwardly from the body 1.

Above the fixing unit 40 is disposed a control box 49 containing therein control parts 50. At a side of control box 49, a ventilating fan 51 is mounted.

Figure 3:
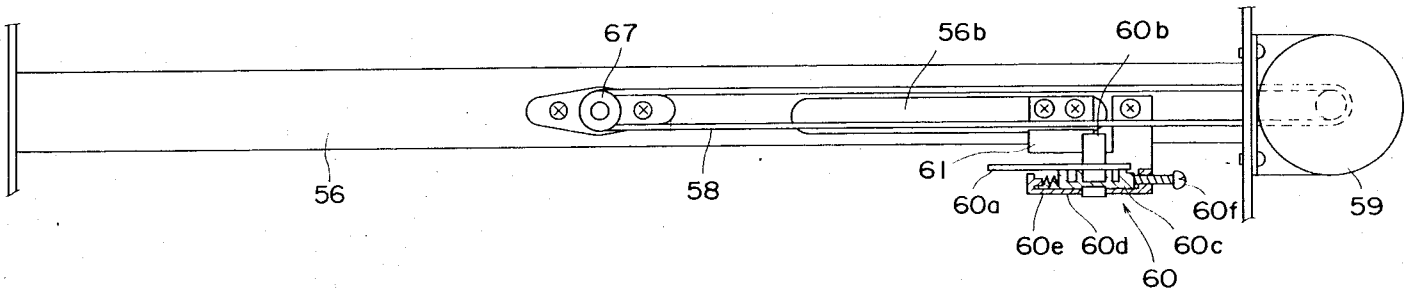
FIG. 3 is a plan view of a portion around a side erase lamp used in the FIG. 1 embodiment.
Figure 4:
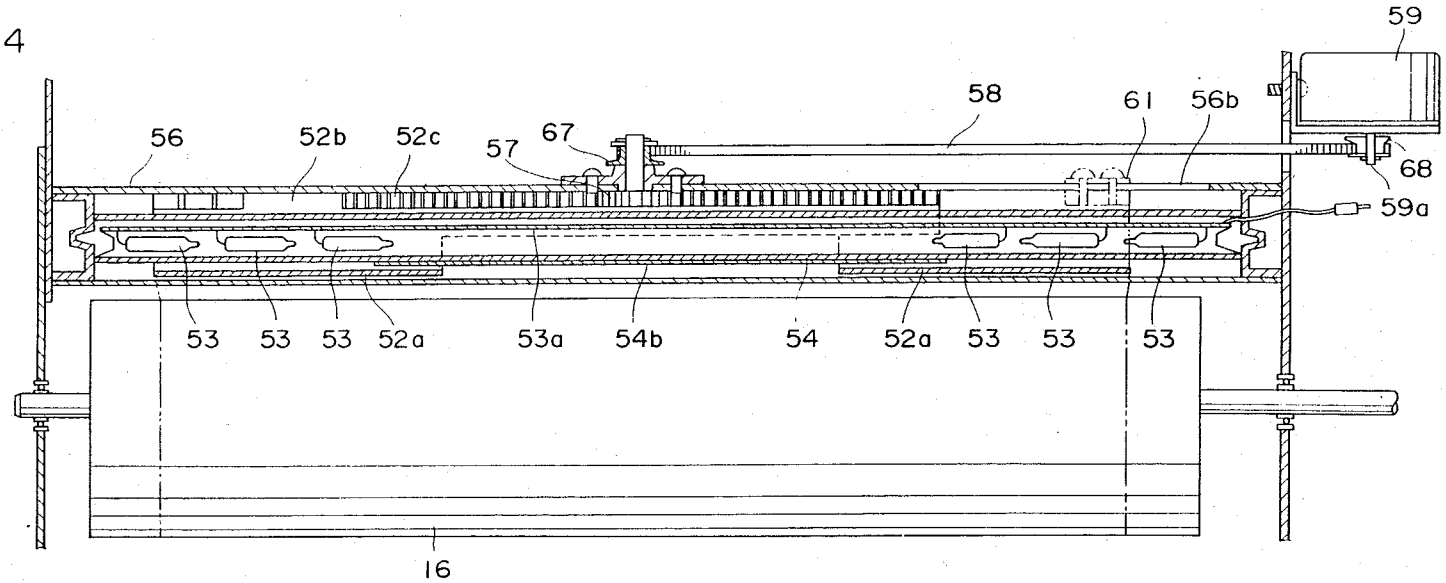
FIG. 4 is a longitudinal sectional view of the portion in FIG. 3.
Figure 5:
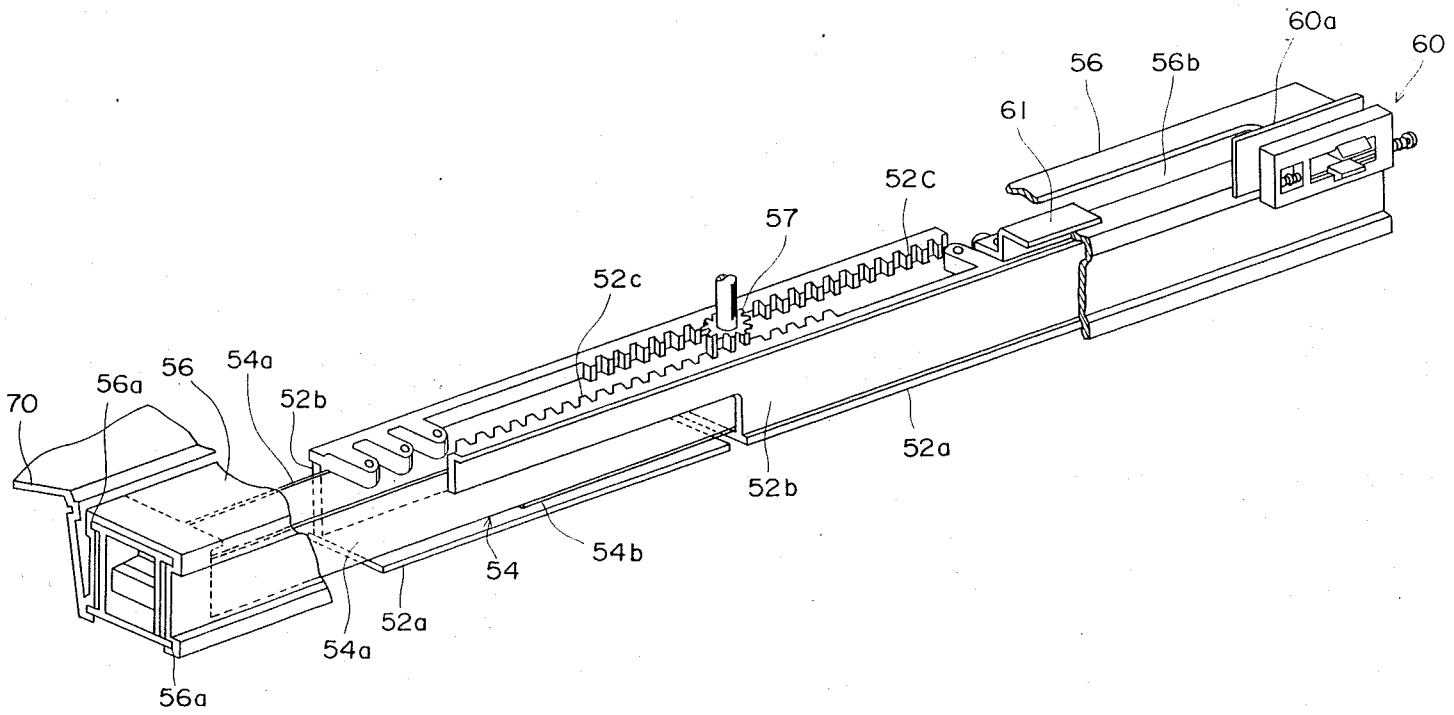
FIG. 5 is a partially cutaway perspective view of the same.

Referring to FIGS. 3 to 5, at the upstream side to the exposure position at the photosensitive drum 16 in the rotation direction thereof, in other words, at the downstream side to the electrified corotron 21, there is provided a hollow-box-like guide rail 56 integral with a support casing 70 for corotron 21, extending in parallel to the axis of photosensitive drum 16, and open at the surface opposite thereto. At the upper and lower portion of opposite inner surfaces of guide rail 56 are formed guide grooves 56*a*, 56*a* extending lengthwise of guide rail 56, the guide rail 56 providing therein a pair of shading members 52, 52 engageable slidably with each guide groove 56*a*. The shading members 52, 52 are the same in construction and symmetrical with respect to the center of guide rail 56, one shading member 52 comprising a shading plate 52*a* of about $\frac{1}{4}$ the length of guide rail 56, covering the opening at one side thereof and opposite to the photosensitive drum 16 and a side plate 52*b* rising at the side of shading plate 52*a* in the rotation direction of photosensitive drum 16. The upper portions of side plates 52*b* at the other side of shading plate 52*a* extend in parallel thereto so that racks 52*c*, 52*c* are formed at the extensions of side plates 52*b*, 52*b*, respectively. A pinion 57 is provided at the lengthwise center of guide rail 56 and between the racks 52*c*, 52*c* in relation of engaging with both the racks 52*c*, 52*c*, the pinion 57 rotating to move the shading members 52, 52 at equal speed toward or away from each other.

In one shading member 52, a home position shutter 61 is mounted to the upper surface of side plate 52*b* at the guide rail 56 end side and projects at the upper portion outwardly through an elongate slot 56*b* formed at one upper end surface of guide rail 56. A home position sensor 60 is mounted onto the upper surface of guide rail 56 at a side of the lengthwise end of elongate slot 56*b*, and has a photocoupler 60*b* which is mounted to a base plate 60*a*. The former comprises a light emitting element and a light receiving element vertically opposite to each other, and is mounted to a mounting member 60*c* which is mounted upon a holder 60*d* fixed to the upper surface of guide rail 56 and slidable lengthwise of guide rail 56. Also, the mounting member 60*c* is biased one-sidedly by a push spring 60*e* interposed between the mounting member 60*c* and the holder 60*d*, capable of being regulated in position through an adjusting screw 60*f*. The screw 60*f* is rotated to change the position of the mounting member 60*c*, and in turn the position of photocoupler 60*b*. The home position shutter 61 is adapted to be positioned at the upper portion thereof between the light emitting element and the light receiving element at the photocoupler 60*b*, and when both the shading members 52, 52 reach the separation limit position, photocoupler 60*b* is positioned between both the elements, causing the photocoupler 60*b* to be in its off condition.

Within the pair of shading members 52, 52 disposed symmetrically with respect to the center of guide rail 56 there is fitted a transparent box-like-shaped lamp casing 54 that is slidable with respect to each shading member 52. A shading film 54*a* is stuck to the surface of lamp case 54 opposite to the side plate 52*b* at each shading plate 52, and a shading film 54*b* is stuck at the lengthwise center of the open side surface (the lower surface) of guide rail 56, except at both lengthwise end portions thereof, in other words, at the center except for both the portions of guide rail 56 opposite to both axial end portions of photosensitive drum 16.

A substrate 53*a* is disposed in the lamp casing 54 and provided at both lengthwise sides with three side erase lamps 53, 53, 53 respectively in relation of being disposed lengthwise of substrate 53 so as to project at the lower portion, the light projection areas of three side erase lamps 53, 53, 53 at the lengthwise end portions of substrate 53*a* being out of the shading film 54 stuck to the lower surface of lamp casing 54 and corresponding to the both axial side edges of photosensitive drum 16. Accordingly, the light from each side erase lamp 53, 53 . . . passes through the lamp casing 54 to reach each axial side edge of photosensitive drum 16, and exposures the side edge of photosensitive drum 16 to the light to thereby dissipate charge on the side edge of the same electrified by the corotron 21. Also, when the shading plate 52*a* covers the light projection area of side erase lamp 53, the light is shaded to prevent light from striking the photosensitive drum 16, whereby the portion covered by the shading plate 52*a* is not exposed.

The pinion 57 projects at a shaft thereof upwardly from the guide rail 56 so that the shaft supports at its upper end a gear 67. A stepping motor 59 is mounted above one lengthwise end (at the slot 56*b* side) of guide rail 56, so that an output shaft 59*a* of motor 59 extends downwardly and carries a gear 68. A timing belt 58 is stretched across the gear 68 and the aforesaid gear 67 so that rotation of stepping motor 59 is transmitted to the pinion 57 through the gear 68, timing belt 58 and gear 67, to thereby move the pair of shading members 52, 52 toward or away from each other. When the shading members 52, 52 move toward each other, the shading plates 52*a*, 52*a* provided under the shading members 52, 52 reduce the portions for covering the light projection areas of side erase lamps 53, 53 . . . within the lamp casing 54 to enlarge the charge dissipation areas at both axial edges of photosensitive drum 16. On the contrary, the shading members 52, 52 move away from each other to expand the portions for covering the side erase lamps 53, 53 . . . light projection areas to restrict the charge dissipation areas at both axial edges of the same.

Figure 6:
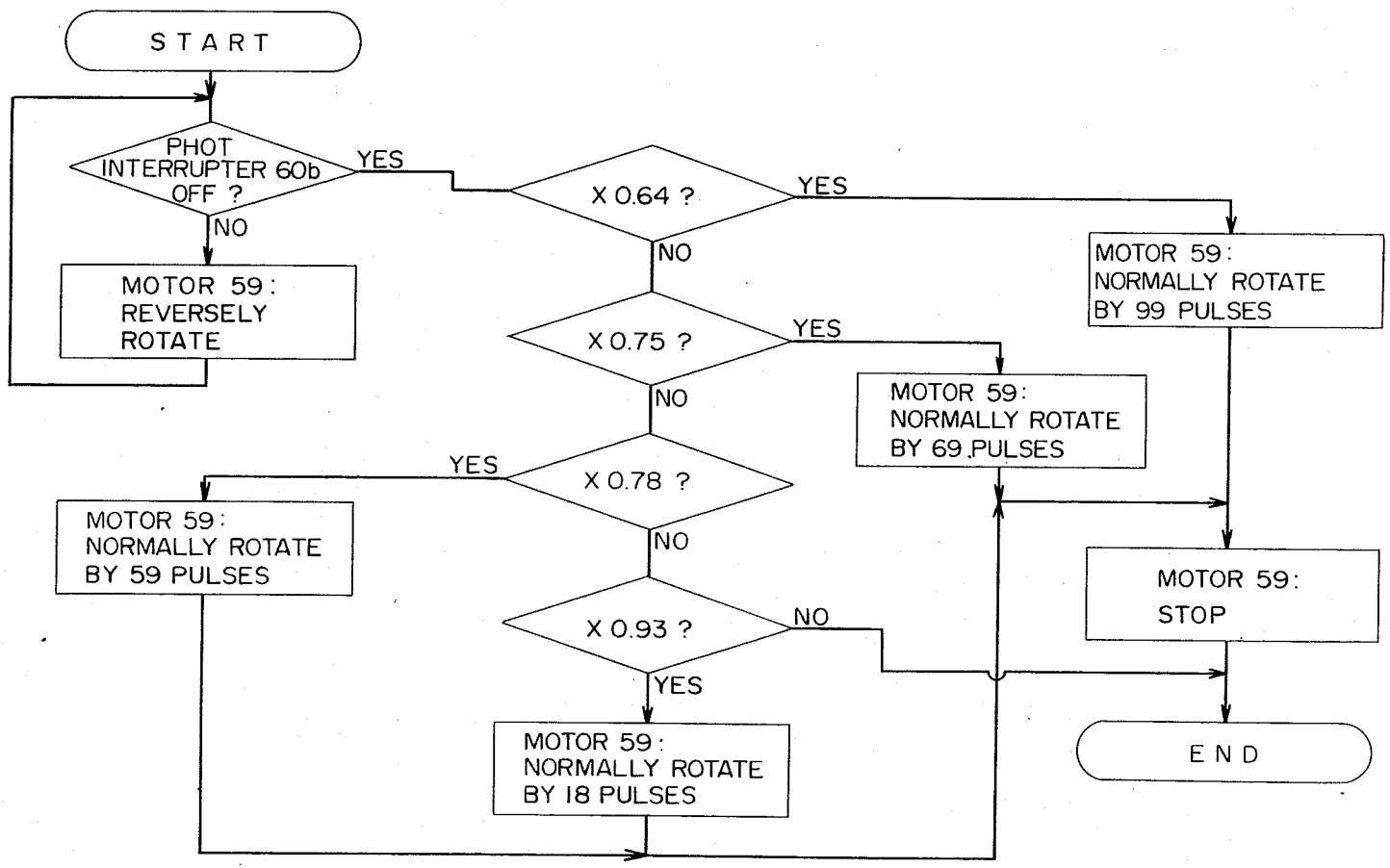
FIG. 6 is a flow chart of side erase control.

FIG. 6 is a flow chart explanatory of operation of the shading members 52, 52 provided under the side erase lamps 53, 53 . . . . When a copy starting button (not shown) is pushed, an output of photocoupler 60*b* of the home position sensor 60 at first is examined, thereby putting the shading members 52 in the condition of moving farthest away from each other. In other words, in the condition of most reducing the light projection areas of side erase lamp 53, 53 . . . , that is, in condition of most restricting the charge eliminating areas at the axial edges of photosensitive drum 16, whereby when the photocoupler 60*b* is on, both the shading members 52, 52 are assumed not to be in the home position where they are most far apart from each other, so that the stepping motor 59 is reversely rotated, and when the photocoupler 60*b* at the home position sensor 60 is off, the stepping motor 59 is stopped of its rotation.

The control of shading members 52, 52 is started on the basis of the above conditions. The copying magnification is decided from the output of a copying magnification setting switch so that, when the copying magnification is 0.64 times to a minimum, the stepping motor 59 is normally rotated only by 99 pulses. Also, when the same is 0.75 times, the motor 59 is normally rotated only by 69 pulses, when 0.78 times, only by 59 pulses, and when 0.93 times, only by 18 pulses. Hence, the pinion 57 rotates by the predetermined amount to thereby move both the shading members 52, 52 toward each other. In this case, since the rack 52*c* at each shading member 52 is formed in equal in pitch, both the shading members 52, 52 move in equal distances and approach each other, whereby the light projection areas under the side erase lamps 53, 53 . . . disposed at both lengthwise end portions are expanded and the central portion of photosensitive drum 16 is not exposed only by length corresponding to each reduction rate, but other side edge portions of the same are exposed.

On the other hand, the photosensitive drum 16 rotates to be uniformly electrified at the axially overall area by the electrification corotron 21, and the original 5 on the original support plate 2 is exposed to the light by the exposure lamp so that the original image reduced into the predetermined magnification by the image lens 15 exposes the electrified photosensitive drum 16, whereby the charge on the exposed portion thereof is dissipated to form the electro-static latent image on the photosensitive drum 16. In this case, since the latent image is reduced from the original 5, both axially end portions of photosensitive drum 16 are larger than those at the original support plate 2, thereby being not exposed and left electrified.

The photosensitive drum 16 on which the reduced original image is formed further rotates to reach the side erase lamps 53, 53 . . . disposing position, then each axially end portion of photosensitive drum 16 is exposed to the light projected from the side erase lamps 53, 53 . . . , thereby dissipating the charge at the same. In this case, the light projection area by the side erase lamps 53, 53 . . . is restricted by the shading member 52*a*, 52*a* at each shading member 52. Hence, the axial portions at the photosensitive drum 16 corresponding to the reduction rate, in other words, a width, when the original support plate 2 is reduced by the predetermined magnification, only is adapted not to be exposed to the side erase lamps 53, 53 . . . , whereby both the axially end portions of photosensitive drum 16 except for the above portion only are reliably exposed, thus dissipating the charge on the side edge portion only.

The electro-static latent image on the photosensitive drum 16 is sensible-imaged with toner by the developing unit 23. In other words, the electrified portion at the photosensitive drum 16 not exposed to the light is attached with toner so as to be sensible-imaged, but each side portion at the photosensitive drum 16 where no original image is formed, is exposed to the side erase lamps 53, 53 . . . corresponding to the reduction magnification to thereby dissipate the charge, thus attaching no toner to the side portion.

The toner image on the photosensitive drum 16 is transferred to the copying paper 19 through the transfer corotron 27, the copying paper 19 being separate from the drum 16 by the separating corotron 28. Also, the toner image on the copying paper 19 is fixed by the fixing unit 40, the remaining toner and charge on the drum 16 being removed by the cleaning unit 35 and the charge-erase lamp 39, respectively.

Alternatively, the shading members 52 of the side erase lamps 53, 53 . . . each may be changed in movement on the basis of the reduction magnification and the size of copying paper 19.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within meets and bounds of the claims, or equivalence of such meets and bounds thereof are therefore intended to be embraced by the claims.

What is claimed is:

1. An electrophotographic copying apparatus which uses means for exposure-scanning an original to form an electrostatic latent image of said original of equal or reduced size on an electrified photosensitive member follow-up-moving in the exposure-scanning direction, said electro-static latent image being developed with toner, so that an image of said toner is transferred to copying paper, characterized by providing;

light sources disposed perpendicularly to the moving direction of said photosensitive member to irradiate the side edge portions thereof perpendicular to the moving direction of the same, thereby erasing unnecessary charge at said side edge portions, respectively;

a shading member movable perpendicularly to the moving direction of said photosensitive member, thereby changing irradiation areas of said light sources;

drive means for driving said shading member;

reduction rate detection means for detecting a reduction rate;

home position detection means for detecting the positioning of said shading member in a home position which is the basic position for controlling thereof; and control means responsive to output signals from both said reduction rate detection means and said home position detection means, for controlling said drive means for first positioning said shading member at the home position whenever the reduction rate is changed, and thereafter at a predetermined position corresponding to the new reduction rate.

2. An electrophotographic copying apparatus as set forth in claim 1, wherein said light sources are disposed opposite to said side edge portions perpendicular to the moving direction of said photosensitive member respectively and irradiate each of said side edge portions at said photosensitive member.

3. An electrophotographic copying apparatus as set forth in claim 2, wherein said shading member is a pair of members for changing the irradiation areas of said light sources at said side edge portions of said photosensitive member respectively.

4. An electrophotographic copying apparatus as set forth in claim 3, wherein said pair of shading members are driven by a common drive means to move in the opposite direction to each other by an equal distance.

5. An electrophotographic copying apparatus as set forth in claim 3, wherein said pair of shading members each have a rack engageable with a pinion provided between said racks.

6. An electrophotographic copying apparatus as set forth in claim 1, wherein said drive means is a stepping motor.

7. An electrophotographic copying apparatus as set forth in claim 1, wherein said shading member is a pair of members, and said detection means is provided at one of said photosensitive member.

8. An electrophotographic copying apparatus as set forth in claim 1, wherein said detection means is a photocoupler.

9. An electrophotographic copying apparatus as set forth in claim 8 wherein said photocoupler is movable in the moving direction of said shading member, biased by a spring in one moving direction of said shading member, and capable of regulating in position by a screw rotating for moving said photocoupler against a biasing force of said spring.

10. An electrophotographic copying apparatus as set forth in claim 1, wherein said shading members are supported to a support member integral with a support member for electrifying means for said photosensitive member.

11. An electrophotographic copying apparatus which uses means for exposure-scanning an original to form an electrostatic latent image corresponding to an original image onto an electrified photosensitive means, said electro-static latent image being developed with toner, thereby developing said toner image on copying paper, characterized by providing;

light sources disposed perpendicularly to the moving direction of said photosensitive member and for irradiating side edge portions of said photosensitive member to erase unnecessary charge at said side edge portions, respectively;

a pair of shading members movable by an equal distance in the direction opposite to each other and perpendicular to the moving direction of said photosensitive member, thereby changing the irradiation areas of said light sources at each of said side edge portions of said photosensitive member;

detection means for detecting that one of the pair of shading members is placed in a home position which is the basic position from which the positioning of said shading member is controlled; and drive means for driving said shading members.

12. An electrophotographic copying apparatus as set forth in claim 11, wherein said pair of shading members each have a rack engageable with a pinion interposed between said racks.

13. An electrophotographic copying apparatus as set forth in claim 11, wherein said drive means is a stepping motor.

14. An electrophotographic copying apparatus as set forth in claim 11, wherein said detecting means is a photocoupler.

15. An electrophotographic copying apparatus as set forth in claim 14, wherein said photocoupler is movable in the moving direction of said shading member, biased by a spring in one moving direction of said shading member, and capable of regulating in position by a screw which rotates to move said photocoupler against a biasing force of said spring.

16. An electrophotographic copying apparatus as set forth in claim 11, wherein said shading members are supported to a support member integral with a support member for said electrifying means for said photosensitive member.

17. An electrophotographic copying apparatus which uses means for exposure-scanning an original to form an electro-static latent image of said original of equal or reduced size on an electrified photosensitive member follow-up-moving in the exposure-scanning direction, said electro-static latent image being developed with toner, so that an image of said toner is transferred to copying paper, characterized by providing;

light sources disposed perpendicularly to the moving direction of said photosensitive member to irradiate the side edge portions thereof perpendicular to the moving direction of the same, thereby erasing unnecessary charge at said side edge portions respectively;

a shading member movable perpendicularly to the moving direction of said photosensitive member, thereby changing irradiation areas of said light sources;

drive means for driving said shading member;

detection means for detecting a reduction rate, said detection means consisting of a photocoupler;

control means for controlling said drive means corresponding to the detection result of said detection means; and said shading member has a home position as the basic position for controlling thereof, and said shading member is provided with detection means for detecting that said shading member is put in the home position.

18. An electrophotographic copying apparatus as set forth in claim 17, wherein said photocoupler is movable in the moving direction of said shading member, biased by a spring in one moving direction of said shading member, and capable of regulating in position by a screw rotating for moving said photocoupler against a biasing force of said spring.

19. An electrophotographic copying apparatus which uses means for exposure-scanning an original to form an electrostatic latent image corresponding to an original image onto an electrified photosensitive member, said electro-static latent image being developed with toner, thereby developing said toner image on copying paper, characterized by providing;

light sources disposed perpendicularly to the moving direction of said photosensitive member and for irradiating side edge portions at said photosensitive member to erase unnecessary charge at said side edge portions respectively;

a pair of shading members movable by an equal distance in the direction opposite to each other and perpendicular to the moving direction of said photosensitive member, thereby changing the irradiation areas of said light sources at said side edge portions of said photosensitive member;

drive means for driving said shading members; and wherein said shading members have a home position as the basic position for controlling thereof, and said shading members are provided with a photocoupler for detecting that said shading members are put in the home position.

20. An electrophotographic copying apparatus as set forth in claim 19, wherein said photocoupler is movable in the moving direction of said shading member, biased by a spring in one moving direction of said shading member, and capable of being regulated in position by a screw which rotates to move said photocoupler against a biasing force of said spring.

* * * * *